US005613550A

United States Patent [19]

Ashida et al.

[11] Patent Number: 5,613,550

[45] Date of Patent: Mar. 25, 1997

[54] TANK FOR A HEAT EXCHANGER

[75] Inventors: Koji Ashida, Kariya; Michiya Takatsuka, Obu; Kazuo Nishizawa, Chiryu, all of Japan

[73] Assignee: Nippondenso Co., Ltd., Kariya, Japan

[21] Appl. No.: 563,362

[22] Filed: Nov. 28, 1995

[30] Foreign Application Priority Data

Nov. 28, 1994 [JP] Japan ..... 6-292796

[51] Int. Cl.[6] ..... F28F 9/007

[52] U.S. Cl. ..... 165/67; 165/76; 165/173; 425/DIG. 58

[58] Field of Search ..... 165/76, 67, 173, 165/153; 425/DIG. 58

[56] References Cited

FOREIGN PATENT DOCUMENTS

| | | | |
|---|---|---|---|
| 76823 | 5/1980 | Japan . | |
| 114541 | 9/1980 | Japan | 425/DIG. 58 |
| 131896 | 5/1989 | Japan . | |
| 30517 | 2/1990 | Japan . | |
| 963056 | 7/1964 | United Kingdom | 425/DIG. 58 |

*Primary Examiner*—Leonard R. Leo
*Attorney, Agent, or Firm*—Cushman, Darby & Cushman IP Group of Pillsbury Madison & Sutro LLP

[57] ABSTRACT

A tank for a heat exchanger is made of resin as a unit by molding with a pair of forming dies and includes a fit base portion for supporting an end of the tube portion to keep a fluid communication between the tank and the tube, and a box-shaped receiving portion integrally formed with an outer side surface of the tank to receive a fastening part. The receiving portion includes a bottom wall extending horizontally, a front wall extending vertically from a front end of the bottom wall and a pair of side walls extending vertically from side ends of the bottom wall in a manner to form a top opening thereby. A notch portion is provided at the front wall and the bottom wall in such a manner that the notch portion extends from a middle portion of the front wall to the bottom wall. The receiving portion for receiving the fastening part can be structured as a unit with only a pair of dies and without an additional mechanism.

13 Claims, 5 Drawing Sheets

TANK FOR A HEAT EXCHANGER

CROSS REFERENCE TO RELATED APPLICATION

This application is based on and claims priority of Japanese Patent Application No. 6-292796, filed Nov. 28, 1994, the content of which is incorporated herein by reference.

BACKGROUND OF THE INVENTION

1. Field of the Invention

The present invention relates to a tank, which is made of resin, for a heat exchanger, and particularly to a structure of the tank into which fixing parts are inserted. For example, the present invention is preferably applied to an automotive radiator.

2. Description of Related Art

Conventionally, the kind of tank for a heat exchanger disclosed in Japanese Patent Application Laid-Open No. Hei 1-131896 has been proposed. In this conventional mechanism shown in FIGS. 5 and 6, a resin tank 110 for an automotive radiator has a gutter-shaped cross section. A receiving portion 120 is formed integrally with an outer wall surface of the tank 110 and the tank receives a nut 130 at the receiving portion 120. The nut 130 fixes a shroud of a radiator cooling blower fan (not shown) on the tank 110.

A mechanism for receiving the nut 130 is described in detail. In FIGS. 5 and 6, the receiving portion 120 has a base wall (basic wall) 121, a front wall 122 and side walls 123 and 124 and is formed into a box shape having an opening at an upper portion thereof. A round hole 125 is provided at the front wall 122 so that a male screw axial portion of a bolt may be inserted into the nut 130.

At a top surface-of the base wall 121, two elastic leg pieces 126 and 127 extending upward are formed integrally. A protrusion portion 131 is formed at a front top portion of the nut 130. An engagement groove 128 engaged with the protrusion 131 is formed on an upper portion of the round hole 125.

The nut 130 is inserted into the receiving portion 120 from an upper side of the receiving portion 120 in such a manner that the nut 130 moves downward while deforming the elastic leg pieces 126 and 127 elastically toward a rear side of the tank 110. After the protrusion 131 enters into the engagement groove 128 and has been engaged therewith, the nut 130 is fixedly received inside the receiving portion 120 by an engagement between the protrusion 131 and the engagement groove 128 and elastic pressure force by the elastic leg pieces 126 and 127.

In the conventional mechanism, the receiving portion 120 has the round hole 125 at the front wall 122 of the receiving portion 120. Since an opening direction of the circular hole 125 is orthogonal to an opening and closing direction of a forming die for forming the tank 110, in order to provide the circular hole 125, an additional mechanism of an undercut treatment such as a sliding core or the like should be provided at the forming die.

FIG. 7 illustrates the cross-sectional view of the forming die which corresponds to the cross section in FIG. 6. A special sliding core 163 is necessary to form the round hole 125 in addition to a lower die 161 and a upper die 162. An arrow Y in FIG. 7 illustrates the opening and closing direction of the lower die 161 and the upper die 162 and an arrow Z illustrates a moving direction of the sliding core 163.

Therefore, in the conventional mechanism, it is necessary to provide the undercut treatment such as the sliding core 163 or the like in the forming die, the cost for forming the tank 110 thereby being increased.

SUMMARY OF THE INVENTION

In view of the foregoing problems, it is a primary object of the invention to provide a tank for a heat exchanger having a receiving portion where the tank is made by a simple-structured forming die without using an additional mechanism such as undercut treatment.

According to the present invention, in a tank for a heat exchanger having a tube, the tank is made of resin as a unit by molding with a pair of forming dies and includes a fit base portion for supporting an end of the tube portion to keep a fluid communication between the tank and the tube, and a box-shaped receiving portion integrally formed with an outer side surface of the tank to receive a fastening part. The receiving portion includes a bottom wall extending horizontally, a front wall extending vertically from a front end of the bottom wall and a pair of side walls extending vertically from side ends of the bottom wall in a manner to form a top opening thereby. A notch portion is provided at the front wall and the bottom wall in such a manner that the notch portion extends from a middle portion of the front wall to the bottom wall.

According to the heat exchanger of the present invention, the receiving portion for receiving and holding a fastening part can be structured as a unit with only a pair of dies and without an additional mechanism for forming a round hole such as an undercut treatment.

Thus, cost for making the forming die can be greatly reduced and a manufacturing cost for the tank of the heat exchanger also can be greatly reduced.

Since a notch portion formed at a front wall of the receiving portion is open from a middle portion of the front wall up to a bottom wall, the notch portion can be formed at a lowest portion of the receiving portion. As a result, when water or the like enters the receiving portion, such liquid can be drained off through the notch portion at the lowest portion.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings.

Figure 1:
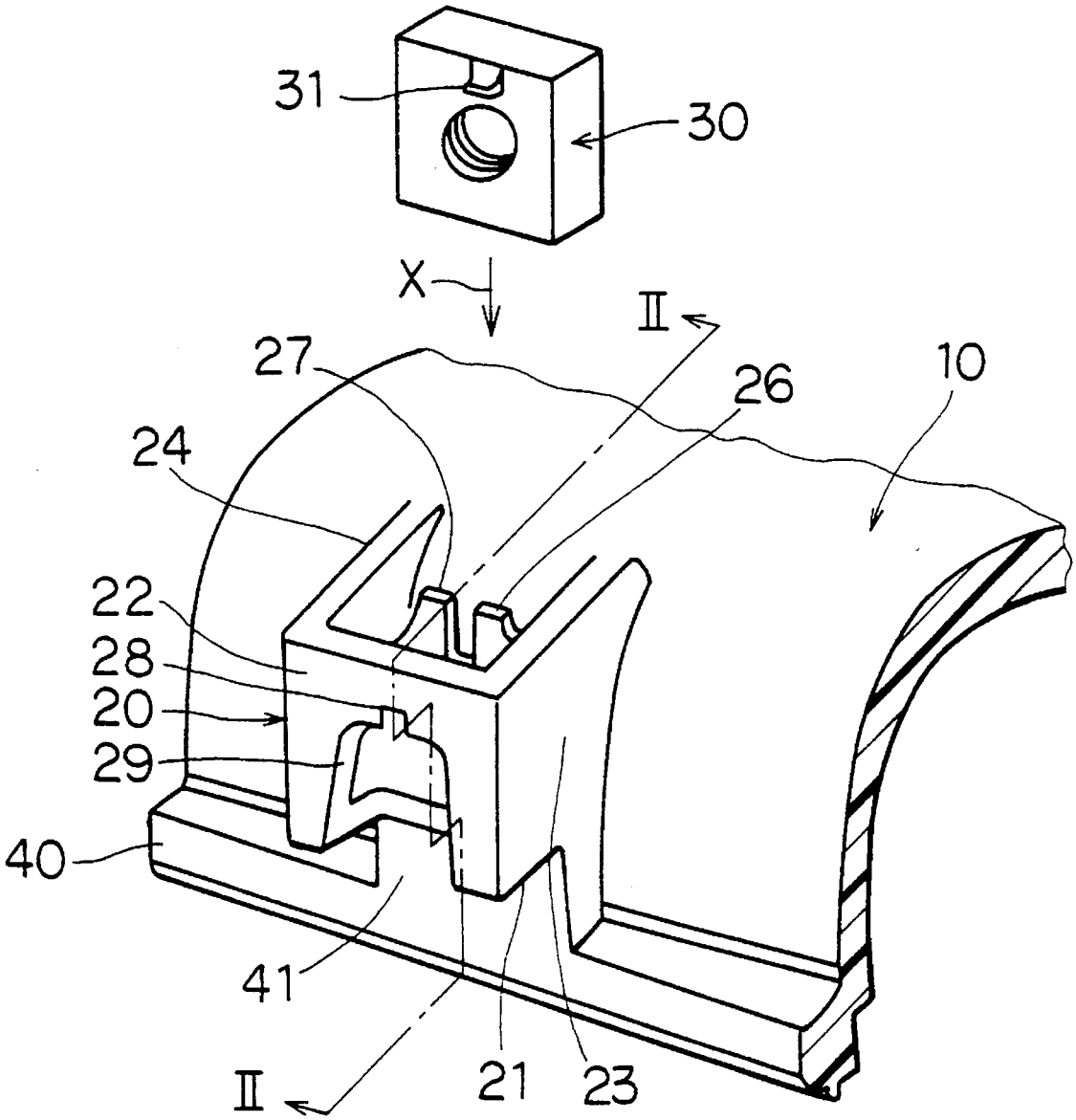
FIG. 1 is a perspective view illustrating a main portion of an automotive radiator tank according to an embodiment of the present invention.
Figure 2:
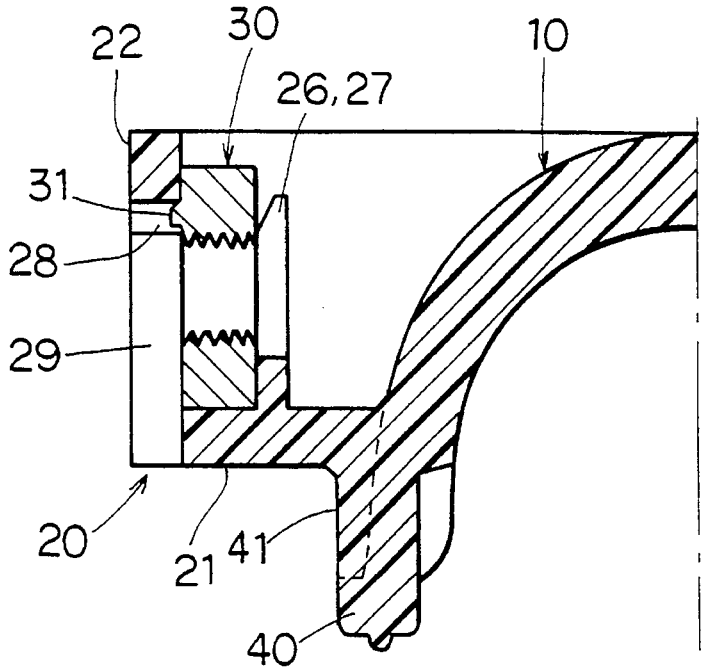
FIG. 2 is a cross sectional view taken along line II—II of FIG. 1.

FIGS. 1 and 2 illustrate an embodiment of the present invention applied to an automotive radiator (an engine cooling water radiator). A tank 10 for delivering cooling water into a tube of a heat exchanger of the radiator is made of resin and disposed at an upper portion or a lower portion of the heat exchanger. It is preferable that material for the tank 10 is a resin with high heat resistance and high strength such as nylon 66 or the like with glass fibers.

The tank 10 is long and narrow in a gutter shape having a U-shaped cross section. A fit base portion 40 is formed around a whole periphery of an opening end surface. The fit base portion 40 supports an end portion of the tube of the heat exchanger and fixes a peripheral edge portion of a core plate (not shown) disposed to close the opening of the tank 10.

A receiving portion 20 is integrally formed at an outer wall surface of the tank 10 to receive and hold a nut 30 as a fastening part. The receiving portion 20 is provided with a bottom wall 21 extending toward a front side from the outer wall surface of the tank 10, a front wall 22 extending generally in an orthogonal direction (upward) from a front end of the bottom wall 21 and side walls 23 and 24 extending in generally the orthogonal direction (upward) from side end portions of the bottom wall 21.

The box-shaped receiving portion 20 having an opening at an upper end portion thereof (an end portion opposite the bottom wall 21) is formed with the bottom wall 21, the front wall 22 and the side walls 23 and 24.

A notch 29 is provided at the front wall 22 and opens from a middle portion below the opening at the upper end portion by a predetermined length to the bottom wall 21. The notch 29 is formed in generally a trapezoid shape which spreads out toward the bottom wall 21. The reason why the notch 29 has such a trapezoid shape is to make it easier to release the forming die after the tank 10 made of resin has been molded, as will be described later. Therefore, an inclination surface of the trapezoid functions as a slope for releasing the forming die.

An outer wall surface 41 between the bottom wall 21 and the fit base portion 40 of the tank end surface is flat along an opening and closing direction of the die for molding. In the opening and closing direction of the die, the outer wall surface 41 and the fit base portion 40 are disposed on the same plane in such a manner that the outer wall surface 41 is not in an undercut shape.

In order to receive and hold the nut 30 in the receiving portion 20, a protrusion 31 is provided at an upper portion of a front side surface of the nut 30 in the same way as in a conventional technique. An engagement groove 28 for engaging with the protrusion 31 is formed at an upper portion of the notch 29.

Two elastic leg pieces 26 and 27 extending upward are formed integrally at an upper portion of the bottom wall 21.

As shown with an arrow X in FIG. 1, the nut 30 is inserted into the receiving portion 20 from the upper side of the receiving portion 20. While deforming the elastic leg pieces 26 and 27 toward the tank 10, the nut 30 is inserted into a space between the front wall and the elastic leg portions and the protrusion 31 of the nut 30 is engaged with the engagement groove 28. Thereby, the nut 30 is securely held inside the receiving portion 20 by an engagement between the protrusion 31 and the engagement groove 28 and by an elastic pressing force by the elastic leg pieces 26 and 27.

A method for molding the tank 10 in the embodiment of the present invention is explained with reference to FIG. 3.

Figure 3:
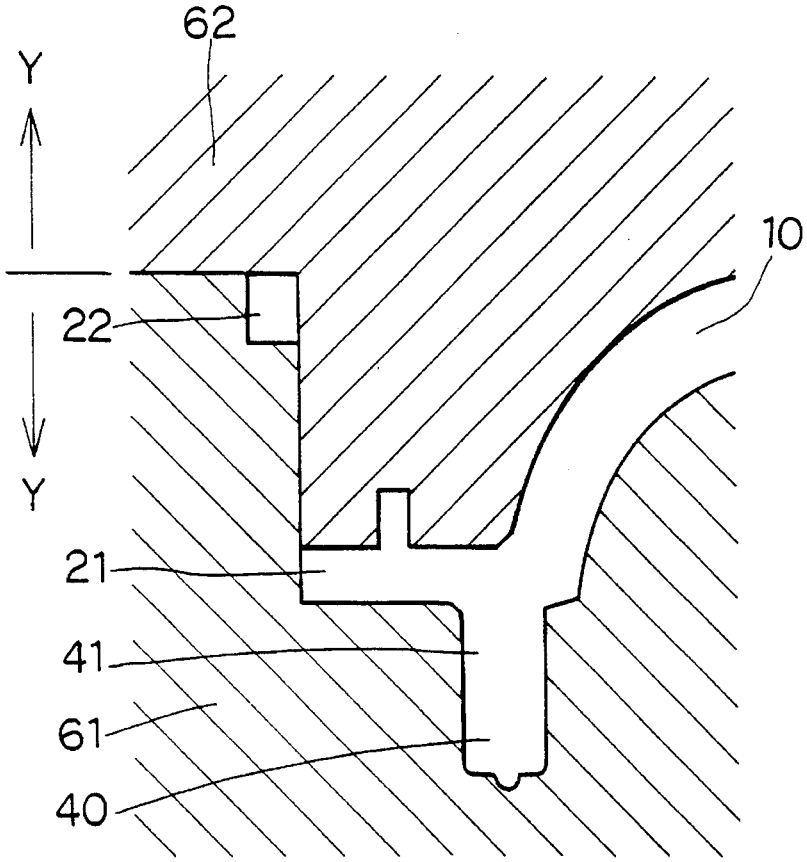
FIG. 3 is a cross sectional view illustrating a main portion of a forming die for forming a cross sectional portion illustrated in FIG. 2.

FIG. 3 illustrates the forming die (molding die) forming the tank 10. By forming the receiving portion 20 for holding the nut 30 of the tank 10 as described above, the receiving portion 20 can be structured without using the undercut treatment. Therefore, as shown in FIG. 3, with a forming die including a lower die 61 and an upper die 62, it is possible to integrally form the tank 10 having the receiving portion 20 by opening and closing the upper and lower dies 61 and 62 in the vertical direction shown with an arrow Y direction.

Figure 4:
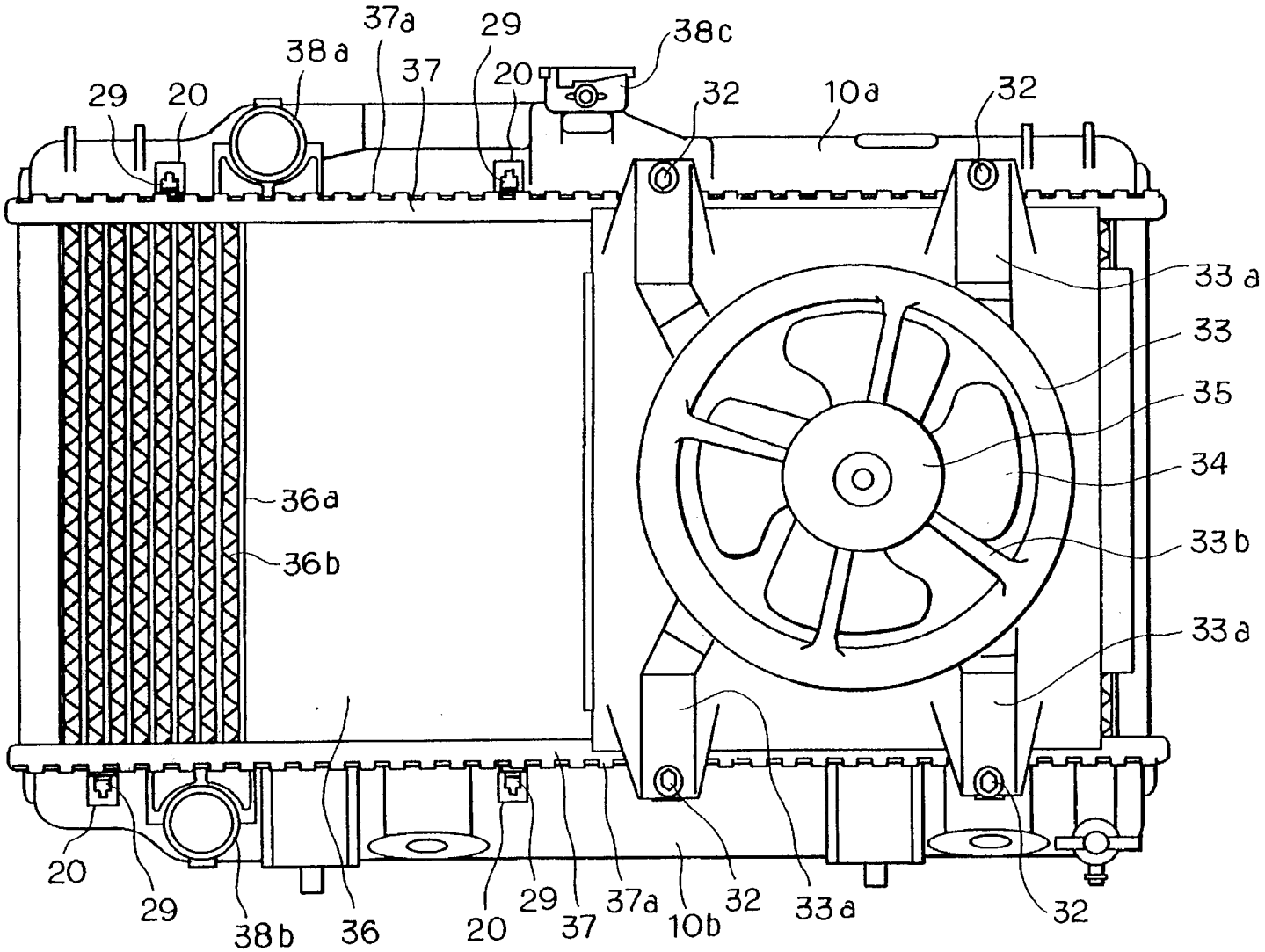
FIG. 4 is a front view illustrating an automotive radiator to which the heat exchanger according to the present invention is applied.
Figure 5:
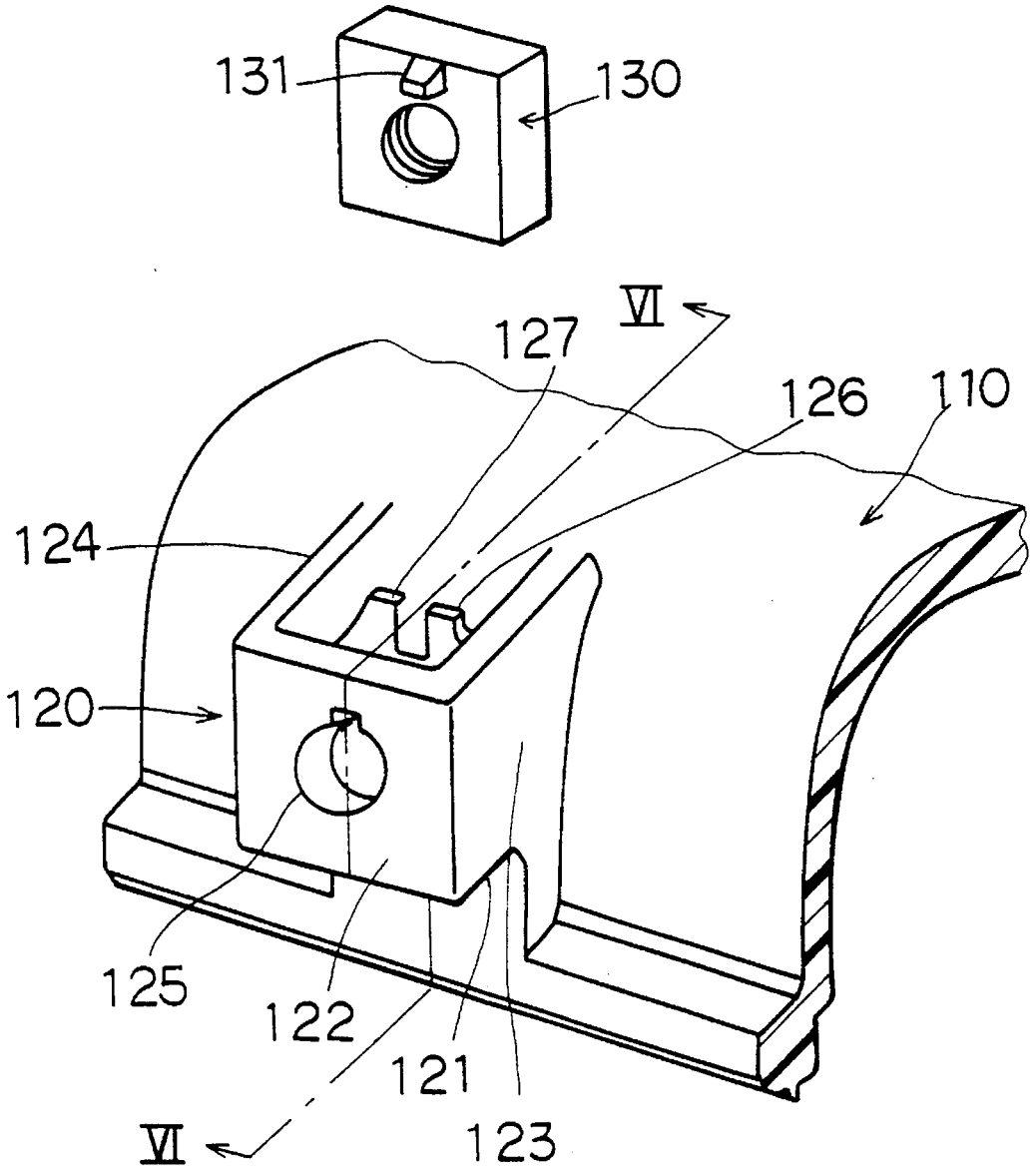
FIG. 5 PRIOR ART
FIG. 5 is a perspective view illustrating a main portion of a tank of a conventional automotive radiator.
Figure 6:
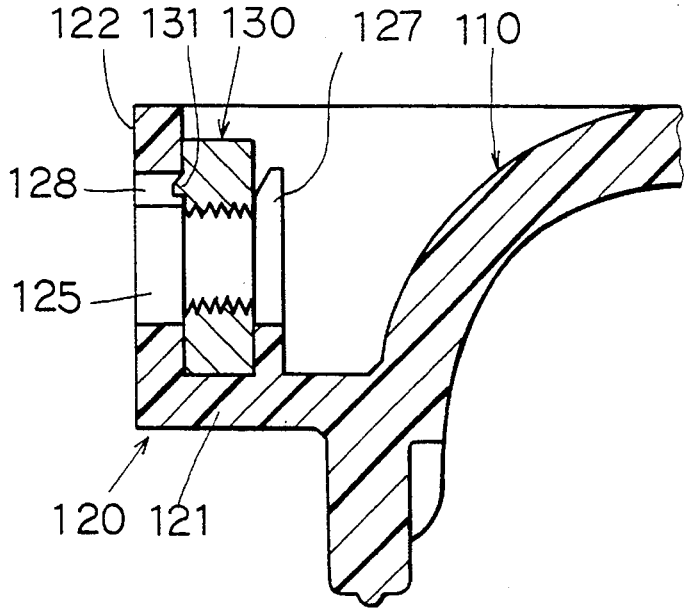
FIG. 6 PRIOR ART
FIG. 6 is a cross sectional view taken along line VI—VI of FIG. 5.
Figure 7:
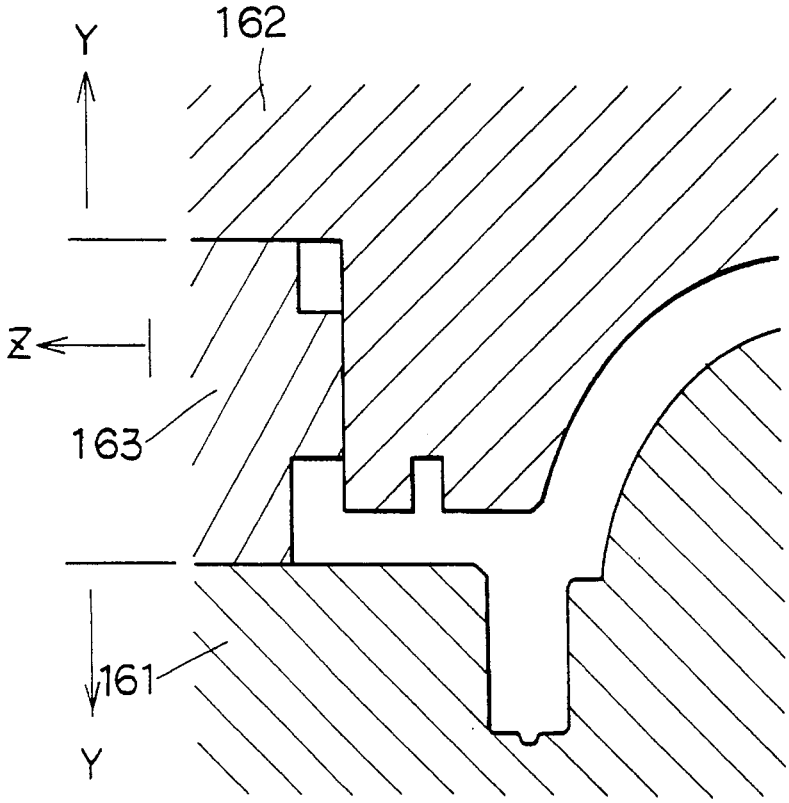
FIG. 7 PRIOR ART
FIG. 7 is a cross sectional view illustrating a main portion of a forming die for forming a cross sectional portion in FIG. 6.

FIG. 4 illustrates an embodiment in which the present invention is applied to an automotive radiator. Four receiving portions 20, which have been described above, are provided at each of a resin upper tank **10*a* and a resin lower tank 10*b*. In FIG. 4, however, the receiving portions 20** on only a left half side of the radiator where a blower fan is taken out are shown.

In FIG. 4, on a right half side of the radiator, a bolt 32 is fastened with the nut 30 received in the receiving portion 20 and a fan shroud 33 is installed on both tanks **10*a* and 10*b*. The fan shroud 33 is normally made of a resin and tip end portions of stays 33*a* of the shroud 33 are fixed to the tanks 10*a* and 10*b* with the bolts 32**.

A motor 35 for driving a blower fan 34 is held and fixed at a center portion of the shroud 33 by leg pieces **33*b***.

A heat exchanging portion (a core portion) 36 includes flat tubes **36*a* and corrugated fins 36*b* joined to the adjacent flat tubes 36*a*. Both end portions of the tube 36*a* are inserted into tube holes provided at respective core plates 37** and connected thereto.

Many claw portions **37*a* are formed at periphery portions of the core plates 37. After an elastic material (e.g., an O ring, not shown) for sealing is provided at an end surface of the fit base portion 40 of the tanks 10*a* and 10*b*, the core plate 37 and the tanks 10*a* and 10*b* are connected integrally by the claw portion 37*a* with the fit base portion 40**.

In FIG. 4, an inlet pipe **38*a* for the engine cooling water, an outlet pipe 38*b* and a water filling inlet 38*b* are shown. Since the receiving portion 20 of the upper tank 10*a* has an opening at the upper portion thereof, even when water or the like enters the receiving portion 20, since the notch 29 formed at the front wall 22 is open to the bottom wall 21 as shown in FIGS. 1 and 2, the notch 29 can be also open at a bottom-most portion of the receiving portion 20. Thus, water or the like entering the receiving portion 20 can be drained off to an outside through the notch 29**. Hence, the groove can be used as a drain port.

In order to hold the nut 30 securely, the embodiment in which the protrusion 31 of the nut 30 is engaged with the engagement portion 28 of the notch 29 is described above. However, since the present invention features the structure of the receiving portion 20 to simplify the structure of forming die for molding resin, a nut receiving mechanism is not limited to the above embodiment. For example, it is acceptable to provide a whole engagement mechanism for securing nuts at a side of the tank 10 instead of providing only the receiving portion 20.

The shape of the nut 30 can be a hexagonal or other shape, instead of a rectangular shape shown in FIG. 4.

The present invention can be applied not only to fastening parts of a bolt and a nut but also to other fastening mechanisms, for example, a cotter pin.

The present invention is not limited to an automotive radiator and can be widely applied to various types of heat exchangers which have a resin tank provided with a receiving portion for fastening parts.

The present invention having been described should not be limited to the disclosed embodiments, but it may be modified in many other ways without departing from the scope and the spirit of the invention. Such changes and modifications are to be understood as being included with the scope of the present invention as defined by the appended claims.

What is claimed is:

1. A tank for a heat exchanger having a tube, said tank being made of resin as a unit by molding with a pair of forming dies and comprising:

a fit base portion for supporting an end of said tube portion to keep a fluid communication between said tank and said tube; and a box-shaped receiving portion integrally formed with an outer side surface of said tank to receive a fastening part, said receiving portion including a bottom wall extending horizontally, a front wall extending vertically from a front end of said bottom wall, and a pair of side walls extending vertically from side ends of said bottom wall in a manner to form a top opening thereby;

wherein said front wall and said bottom wall have a notch portion extending from a middle portion of said front wall to said bottom wall.

2. The tank for a heat exchanger according to claim 1, further comprising a supporting portion for supporting between said bottom wall of said receiving portion and said outer side surface of said tank, said supporting portion having a front surface, wherein said front surface of said supporting portion and said outer side surface of said tank are disposed on an identical plane along an opening and closing direction of said pair of forming dies.

3. The tank for a heat exchanger according to claim 1, wherein said notch portion spreads out in width gradually toward said bottom wall.

4. The tank for a heat exchanger according to claim 3, wherein a side edge surface of said fit base portion is disposed on said identical plane with said front surface of said supporting portion.

5. The tank for a heat exchanger according to claim 1, wherein said fastening part received in said receiving portion is a nut into which a male screw is driven, and an axis portion of said male screw passes through said notch portion.

6. The tank for a heat exchanger according to claim 1, wherein said notch portion is used as drain opening for draining water entering said receiving portion.

7. A heat exchanger for exchanging heat between water and air, said heat exchanger comprising:

(a) a core portion having a plurality of flat tubes through which said water passes and at least one corrugated fin disposed between adjacent flat tubes;

(b) a pair of upper and lower tanks, each of which is made of resin as a unit by molding with a pair of forming dies, each of said tanks having:

(b1) a fit base portion for supporting an end of said flat tube portion to keep a fluid communication between said tank and said flat tube, and (b2) a box-shaped receiving portion integrally formed with an outer side surface of said tank, said receiving portion including a bottom wall extending horizontally, a front wall extending vertically from a front end of said bottom wall, and a pair of side walls extending vertically from side ends of said bottom wall in a manner to form a top opening thereby, wherein said front wall and said bottom wall have a notch portion extending from a middle portion of said front wall to said bottom wall, (c) a ventilating fan for ventilating said air toward said core portion; and (d) fastening means disposed in said receiving portions of said pair of upper and lower tanks for fastening said ventilating fan at said receiving portions.

8. The heat exchanger according to claim 7, wherein each of said tank further includes a supporting portion for supporting between said bottom wall of said receiving portion and said outer side surface of said tank, said supporting portion having a front surface, and said front surface of said supporting portion and said outer side surface of said tank are disposed on an identical plane along an opening and closing direction of said pair of forming dies.

9. A tank comprising:

(a) a tank body; and (b) a connecting portion disposed on said tank body;

wherein said connecting portion has (b1) a first opening for receiving a first fastening element in said connecting portion, and (b2) a second opening for receiving a second fastening element, said second opening extending from an edge of said connecting portion opposite said first opening to a portion of said connecting portion between said first opening and said edge.

10. The tank according to claim 9, wherein said connecting portion is integral with said tank body.

11. The tank according to claim 9, wherein a width of said second opening in a direction of said edge increases from said portion of said connecting portion to said edge.

12. The tank according to claim 9, wherein said second opening additionally extends from said edge into a portion of said connecting portion opposite said first opening.

13. The tank according to claim 9, further comprising drain means, disposed on a portion of said connecting portion opposite said first opening, for draining water in said connecting portion.

* * * * *